US008139803B2

(12) United States Patent
Afshar

(10) Patent No.: US 8,139,803 B2
(45) Date of Patent: Mar. 20, 2012

(54) SYSTEMS AND METHODS FOR HAPTIC SOUND

(75) Inventor: Shahriar S. Afshar, Boston, MA (US)

(73) Assignee: Immerz, Inc., Cambridge, MA (US)

( * ) Notice: Subject to any disclaimer, the term of this patent is extended or adjusted under 35 U.S.C. 154(b) by 1511 days.

(21) Appl. No.: 11/433,858

(22) Filed: May 12, 2006

(65) Prior Publication Data

US 2007/0038164 A1 Feb. 15, 2007

Related U.S. Application Data

(60) Provisional application No. 60/716,165, filed on Sep. 12, 2005, provisional application No. 60/737,526, filed on Nov. 16, 2005, provisional application No. 60/708,205, filed on Aug. 15, 2005, provisional application No. 60/755,422, filed on Dec. 31, 2005.

(51) Int. Cl.
*H04R 1/02* (2006.01)

(52) U.S. Cl. ..... 381/333; 381/385; 381/334; 600/26; 600/27; 601/46; 601/47

(58) Field of Classification Search ..... 381/333–334, 381/385, 61–62, 67; 181/130–131; 600/46–47, 600/26–28; 601/26–28, 46–47
See application file for complete search history.

(56) References Cited

U.S. PATENT DOCUMENTS 4,589,138 A * 5/1986 Milner et al. ..... 381/110
4,821,323 A 4/1989 Papiernik
5,436,556 A * 7/1995 Komninos ..... 324/76.23
5,553,148 A 9/1996 Werle
5,565,840 A 10/1996 Thorner et al.
5,635,686 A * 6/1997 Fenton ..... 181/144
5,641,928 A * 6/1997 Tohgi et al. ..... 84/613
5,680,465 A 10/1997 Boyden
5,682,434 A 10/1997 Boyden
5,687,244 A 11/1997 Untersander
D411,576 S 6/1999 Hames
5,973,422 A 10/1999 Clamme (Continued)

FOREIGN PATENT DOCUMENTS

EP 1533678 A1 5/2005

(Continued)

OTHER PUBLICATIONS

Gunther, et al., "Cutaneous Grooves: Composing for the Sense of Touch," Proceedings of the 2002 Conference on the New Instruments for Musical Expression (NIME-02), Dublin, Ireland, May 24-26, 2002, pp. 1-6.

*Primary Examiner* — Devona Faulk
*Assistant Examiner* — Disler Paul
(74) *Attorney, Agent, or Firm* — Ropes & Gray LLP

(57) ABSTRACT

Systems and methods for applying vibration to the human body. A vibration system includes a vibrator capable of converting an electrical signal into vibration. In one aspect, the vibrator is arranged on or about the human body on a pectoralis major muscle and spaced away from a sternum. In another aspect, the vibrator is arranged on or about the human body such that a first pattern of vibrations are generated on the body's surface. The first pattern of vibrations matches in relative amplitude a second pattern of vibrations generated on the body's surface when the body generates sound.

32 Claims, 14 Drawing Sheets

U.S. PATENT DOCUMENTS

| | | | | |
|---|---|---|---|---|
| 6,065,134 | A * | 5/2000 | Bair et al. | 714/6.11 |
| 6,065,154 | A * | 5/2000 | Hulings et al. | 2/102 |
| 6,275,213 | B1 | 8/2001 | Tremblay et al. | |
| 6,424,333 | B1 | 7/2002 | Tremblay et al. | |
| 6,463,157 | B1 | 10/2002 | May | |
| 6,603,863 | B1 * | 8/2003 | Nagayoshi | 381/380 |
| 6,763,119 | B2 | 7/2004 | Lee | |
| 7,035,422 | B1 * | 4/2006 | Wiener | 381/388 |
| 7,331,871 | B2 * | 2/2008 | Lopez | 463/47 |
| 2001/0003166 | A1 * | 6/2001 | Gulick | 700/94 |
| 2002/0148871 | A1 | 10/2002 | Nakano et al. | |
| 2003/0012394 | A1 * | 1/2003 | Lee | 381/380 |
| 2003/0012397 | A1 | 1/2003 | Gurner | |
| 2003/0206642 | A1 | 11/2003 | Menzies | |
| 2005/0245910 | A1 * | 11/2005 | Wright et al. | 606/1 |
| 2005/0250582 | A1 | 11/2005 | Lopez | |

FOREIGN PATENT DOCUMENTS

| | | | |
|---|---|---|---|
| EP | 1535594 | A1 | 6/2005 |
| EP | 1561446 | A | 8/2005 |
| GB | 2439014 | A | 12/2007 |
| JP | 8116581 | | 5/1996 |
| WO | WO 00/67693 | | 11/2000 |
| WO | WO 02/053246 | A2 | 7/2002 |
| WO | WO 03/023762 | A1 | 3/2003 |
| WO | WO 2004/082325 | A2 | 9/2004 |
| WO | WO 2005/022872 | A1 | 3/2005 |
| WO | WO 2005/053351 | A1 | 6/2005 |

* cited by examiner

SYSTEMS AND METHODS FOR HAPTIC SOUND

RELATED APPLICATIONS

This application claims the benefit of: U.S. provisional application 60/708205, filed Aug. 15, 2005 entitled "Vibroblast: a low-power bass speaker system that vibrates the body", U.S. provisional application 60/716165, filed Sep. 12, 2005 entitled "ThoraPhone: method and means to deliver audio bass to the thorax and/or cervix of listener", U.S. provisional application 60/737526, filed Nov. 16, 2005 entitled "ThoraBlast: method and means to deliver bass to the listener", and U.S. provisional application 60/755422, filed Dec. 31, 2005 entitled "ThoraBlast: Super-immersive haptic sound technique and apparatus", the specifications of which are incorporated by reference herein.

BACKGROUND

Today there are many multimedia systems that present audio and visual data to a user. As devices decrease in size and become more portable, screen size and sound quality decrease as well, adversely affecting the user's interaction with the data being presented. Existing methods for supplementing a user's experience have drawbacks which compromise the user's comfort and perception of the content being presented. For example, audio speakers intended for individual use, such as those found in headphones, are either too small to generate sound over a wide frequency range or so large as to be uncomfortable and cumbersome. Other devices attempt to compensate for speakers that are unable to generate low frequency sound by applying vibrations to the user. Many of these devices are uncomfortable or distracting to use, especially after prolonged use. For example, some devices apply vibrations to the head of the user, which can cause headaches, or to a location on the posterior side of the user, which unintentionally gives the impression the sound originates from behind the user. Furthermore, home theatre or personalized vibrating chair surround sound systems with large woofers are prohibitively expensive; and since the low frequency sound easily penetrates walls, the bass component of the sound is usually bothersome to user's neighbors, thus rendering the systems unsuitable for apartment complexes.

A need exists for systems and methods that improve the user's interaction with the content being presented. It is desirable that the system does not distract from the content being presented. It is also desirable that the system be easy to use, portable, inexpensive, and suitable for long term use.

SUMMARY

Disclosed herein are systems and methods for applying vibration to the body of a user to enhance the user's interaction with and perception of content being presented. Locations on the body for receiving vibrations are disclosed along with characteristics of locations. Illustrative embodiments of vibration systems are described, including vibrators for converting data to vibration and support structures for supporting and positioning the vibrators. Other devices that may be used in conjunction with the vibrators are described, including audio speakers, signal processors and media devices.

In one aspect of the invention, a vibration system comprises a vibrator capable of converting an electrical signal into vibration. The vibrator can be arranged on or about a human body on a pectoralis major muscle and spaced away from the sternum. The vibration system can include at least one of a support structure for arranging the vibrator, an audio speaker for generating sound, and a video display for generating a visual image.

The vibration system can include a second vibrator arranged on or about the body on a pectoralis major muscle and spaced away from the sternum. In one configuration, the support structure disposes the vibrators on a front-back coronal plane of the body and symmetrically across a left-right median plane of the body.

In one implementation of the invention, the support structure includes at least one curved harness, with each harness adapted to fit over a shoulder of the body. Each harness can have two ends configured to flex inwardly toward each other to push a vibrator against the body. The support structure can include an adjustable endpiece that is nested within a free end of each curved harness and is capable of sliding in and out of the free end. Each curved harness can have a harness joint within its midsection that is adapted to allow a free end of each curved harness to fold towards a point of attachment of two curved harnesses. A vibrator joint can join the vibrator to a free end of a curved harness. The vibrator joint can be adapted to adjust an angle between the vibrator and the free end. A vibrator can be positioned at a point of attachment of two curved harnesses and be adapted to convert a rear channel electrical audio signal of a surround sound system into a vibration.

In another implementation of the invention, the support structure includes a bent element that is adapted to fit on a front of a shoulder of the body and has an end adapted to attach to the vibrator. A vibrator joint can join the vibrator to the bent element and be adapted to adjust an angle between the vibrator and the bent element. The support structure can include a semi-circular element that is adapted to fit around the back of the neck of the body and has two ends each adapted to attach to a bent element. A bent element joint can join a bent element to the semi-circular element and be adapted to fold the bent element and the semi-circular element together in a common plane. The support structure can include a long element vertically centered on an upper back of the body, attached to a midpoint of the semi-circular element at an angle adapted to push a vibrator against the body. A midpoint joint can join the long element to the semi-circular element and be adapted to fold the two elements together in a common plane.

In another implementation of the invention, the support structure includes a stretchable band adapted to fit over a shoulder and fastener means adapted to fasten the stretchable band to a waistband.

The vibration system can feature at least one of a pitch controller, a volume controller, a fade-in device, an amplitude-ceiling device, and a bass-enhancement device. The pitch controller can modulate a pitch characteristic of an electrical signal. The volume controller can raise and lower an amplitude characteristic of an electrical signal. The fade-in device can gradually raise an amplitude characteristic of an electrical signal. The amplitude-ceiling device can impose an upper limit on an amplitude characteristic of an electrical signal. The bass-enhancement device can sample a first electrical signal to create a sampled signal, modulate a pitch characteristic of the sampled signal to create a modulated sampled signal, and mix the modulated sampled signal with the first electrical signal. The vibration system can also feature a signal processing device capable of detecting that no electrical signal has been received for a preset amount of time, a power supply for powering a signal processing device, and an automatic shut-off device that can turn off the signal processing device in response to the signal processing device detecting that no electrical signal is being received for the preset amount of time. The vibration system can also feature a low frequency cross-over circuit capable of filtering through low frequency sound from an electrical signal and an amplifier capable of amplifying the electrical signal.

In another implementation of the invention, the vibrator includes at least one of an inertial transducer, an off-balance rotor, a tactile transducer, or a piezoelectric transducer. A surface of the vibrator can be made of at least one of synthetic rubber, foam cushion, polyurethane, speaker cover fabric, or silicone. A surface of the support structure can be made of at least one of synthetic rubber or speaker cover fabric.

In another aspect of the invention, a vibration system includes a vibrator capable of converting an electrical signal into a vibration and a support structure for arranging the vibrator. The support structure can arrange the vibrator at a location on or about a human body such that a first pattern of vibrations are generated on the body's surface, where the first pattern matches in relative amplitude a second pattern of surface vibrations generated when the body generates sound. The vibration system can include at least one of an audio speaker for generating sound and a video display for generating a visual image. The support structure can dispose a plurality of vibrators on a front-back coronal plane of the body and symmetrically across a left-right median plane of the body. The vibrator can be arranged on or about a side of a torso of the body. In one implementation of the invention, the support structure includes a stretchable band adapted to encircle a torso of the body.

BRIEF DESCRIPTION OF THE DRAWINGS

The foregoing and other objects and advantages of the invention will be appreciated more fully from the following further description thereof, with reference to the accompanying drawings wherein.

DESCRIPTION OF ILLUSTRATED EMBODIMENTS

To provide an overall understanding of the invention, certain illustrative embodiments will now be described.

Figure 2:
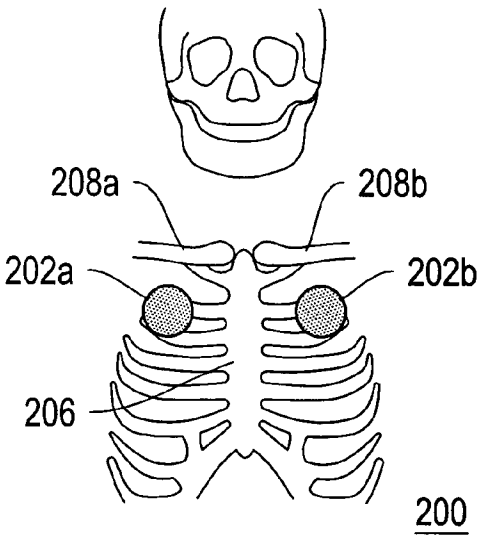
FIG. 2 depicts a front view of vibrator locations with respect to the body's underlying skeletal system.
Figure 1:
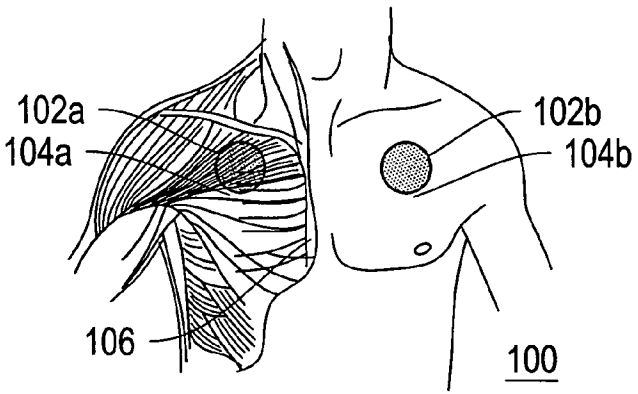
FIG. 1 depicts a front view of vibrator locations with respect to the body's underlying musculature.
Figure 3:
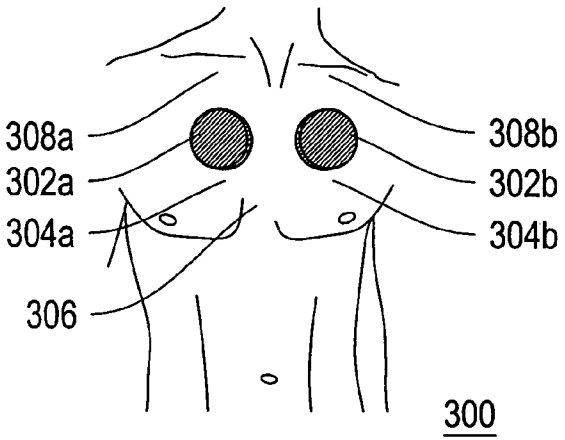
FIG. 3 depicts a front view of vibrator locations with respect to the body's external surface.
Figure 4B:
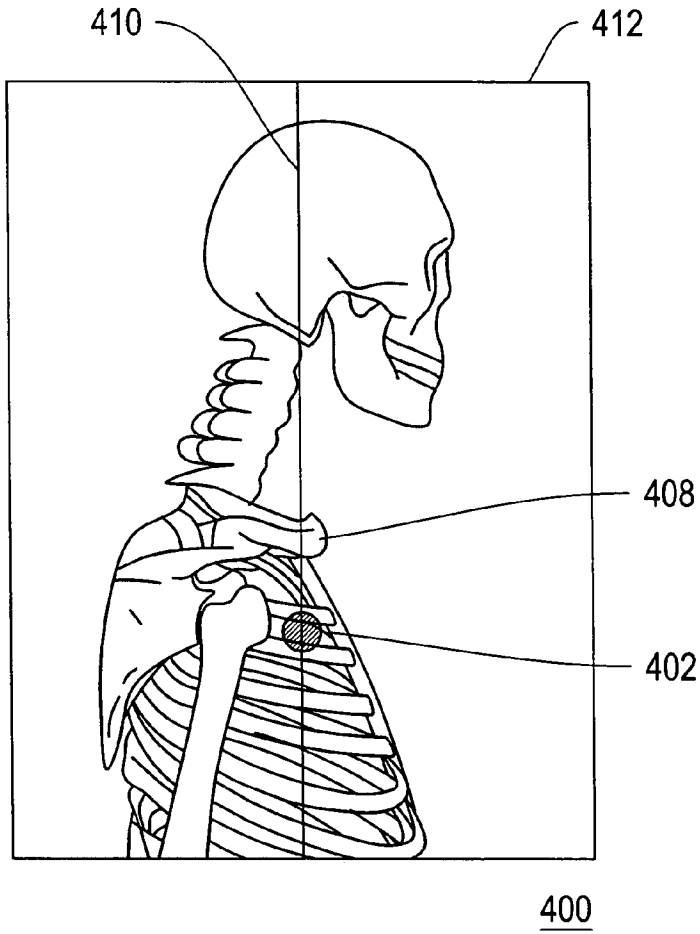
FIGS. 4A and 4B depict, respectively, an oblique view and a side view of vibrator locations with respect to the body's anatomical planes.

Turning to FIGS. 1-4B, there are depicted vibrator location arrangements 100, 200, 300, and 400 on a human body. In particular, FIG. 1 depicts vibrator locations 102*a* and 102*b* with respect to the body's underlying musculature. FIG. 2 depicts vibrator locations 202*a* and 202*b* with respect to the body's underlying skeletal system. FIG. 3 depicts vibrator locations 302*a* and 302*b* with respect to the body's external surface. FIGS. 4A and 4B depict, respectively, an oblique view and a side view of vibrator location 402 with respect to the body's anatomical planes.

As depicted by FIG. 1, vibrator location arrangement 100 has vibrator locations 102*a* and 102*b* disposed symmetrically across the chest of the body. A first vibrator location 102*a* is located adjacent to a first pectoralis major muscle 104*a*, and similarly a second vibrator location 102*b* is located adjacent to a second pectoralis major muscle 104*b*. Both vibrator locations 102*a* and 102*b* are spaced away from the sternum 106.

As depicted by FIG. 2, vibrator location arrangement 200 has vibrator locations 202*a* and 202*b* disposed symmetrically across the chest of the body. A first vibrator location 202*a* is located inferior to a first clavicle bone 208*a*, and similarly a second vibrator location 202*b* is located inferior to a second clavicle bone 208*b*. Both vibrator locations 202*a* and 202*b* are spaced away from the sternum 206.

As depicted by FIG. 3, vibrator location arrangement 300 has vibrator locations 302*a* and 302*b* disposed symmetrically across a chest of the body. A first vibrator location 302*a* is located adjacent to a first pectoralis major muscle 304*a* and inferior to a first clavicle bone 308*a*; and similarly a second vibrator location 302*b* is located adjacent to a second pectoralis major muscle 304*b* and inferior to a second clavicle bone 308*b*. Both vibrator locations 302*a* and 302*b* are spaced away from a sternum 306.

Figure 4A:
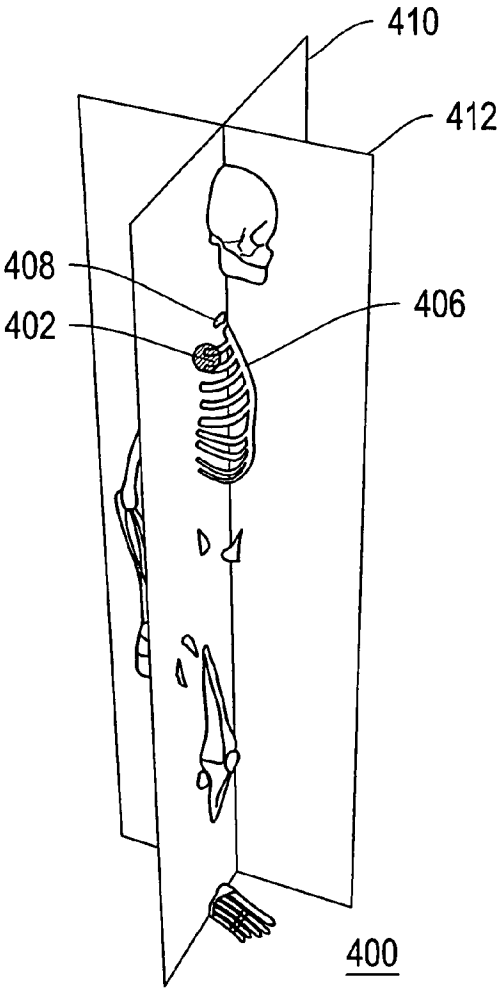

As depicted by FIGS. 4A and 4B, vibrator location arrangement 400 includes vibrator location 402 disposed on a front-back coronal plane 410 of the body, inferior to a clavicle bone 408, and spaced away from a sternum 406. Vibrator location arrangements can also be symmetric across the left-right median plane 412. In particular, a second vibrator location can be disposed opposite vibrator location 402 such that the two locations are symmetric with respect to the left-right median plane 412.

Figure 5:
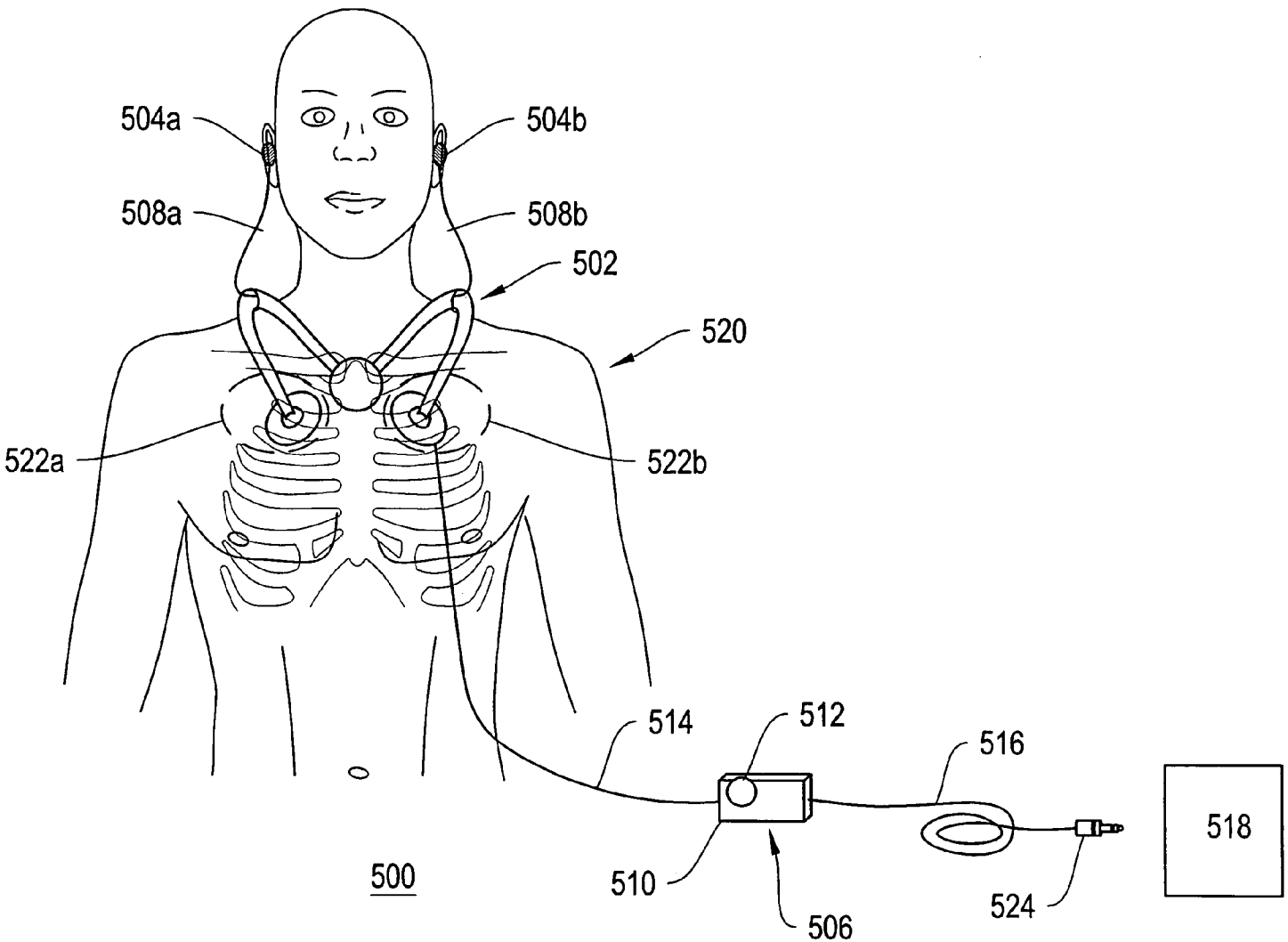
FIG. 5 depicts a front view of an exemplary vibration system for experiencing audio and haptic data.

FIG. 5 depicts an exemplary vibration system 500 for experiencing audio and haptic data. The vibration system 500 is depicted on a human body 520 having vibrator locations 522*a* and 522*b*. The vibration system 500 includes a vibration device 502, optional audio speakers 504*a* and 504*b*, and a processor 506. The vibration device 502 is described below in reference to FIGS. 6A-8. The optional audio speakers 504*a* and 504*b* can be any suitable audio device, such as an earphone, headphone, or neckphone, and can be attached by wires 508*a* and 508*b* to the vibration device 502. Alternatively, the audio speakers can be separate from the vibration device 502 or the user can opt to not have or use audio speakers in conjunction with the vibration device 502.

Figure 19:
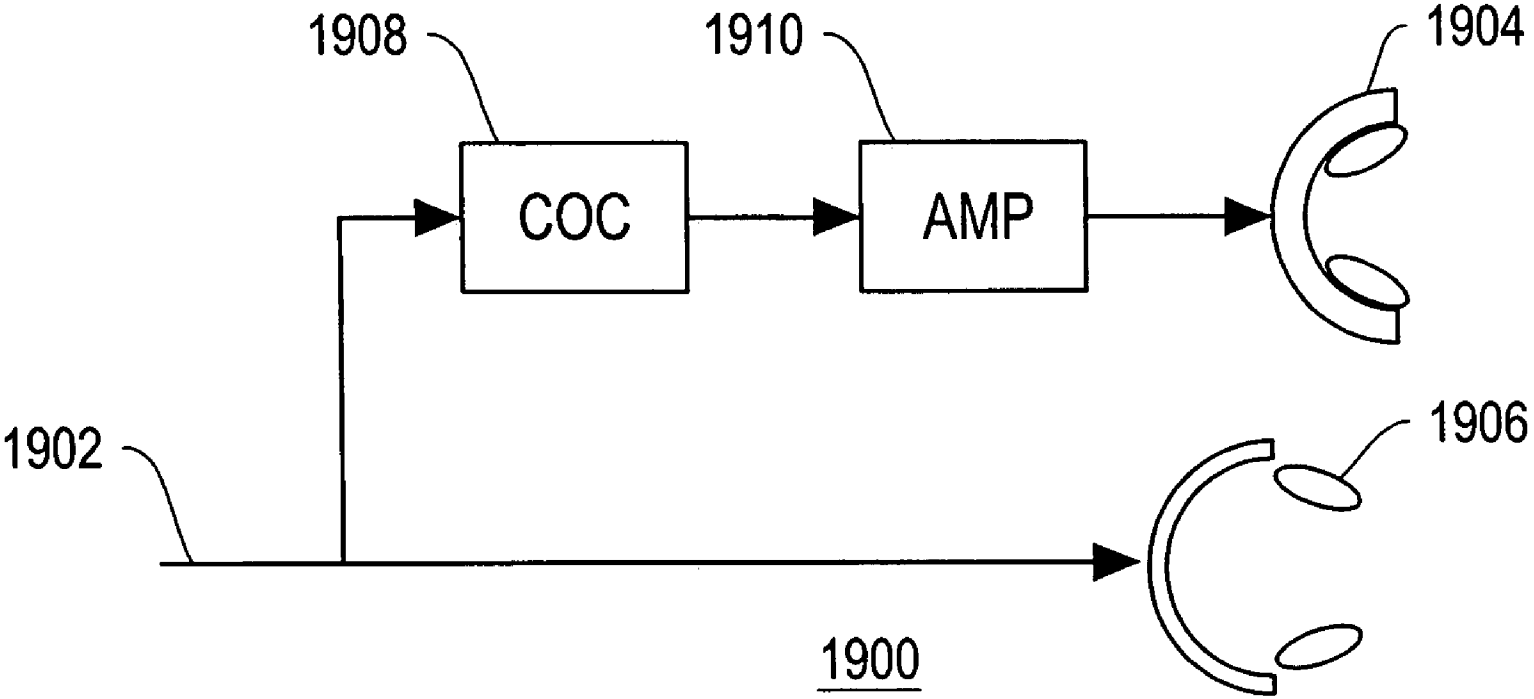
FIG. 19 depicts an exemplary block diagram of processing circuitry that can be used in a vibration system.

The depicted processor 506 includes a housing 510 that encases the processing circuitry, such as the processing circuitry described below in reference to FIG. 19, and supports user control interfaces such as a button, switch, or dial 512. The housing 510 can attach by wire 514 to the vibration device 502 and by wire 516 to any suitable data source 518 of audio or haptic data, such as a portable music device or video game console. The wires 514 and 516 may each have an audio jack, such as the audio jack 524 attached to the end of the wire 516, for connecting to, respectively, the processor 506 and the data source 518. Alternatively, the vibration device 502 can attach directly to a data source 518. In another alternative embodiment, the vibration device 502, the processor 506, and the data source 518 can include, respectively, a wireless receiver, a wireless transceiver, and a wireless transmitter for communicating audio or haptic data.

Figure 6B:
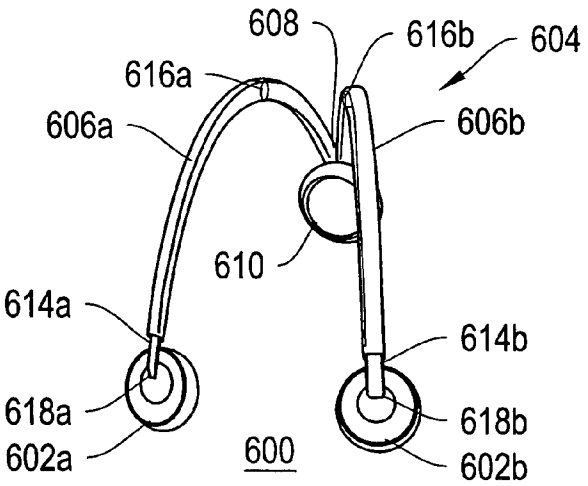
FIGS. 6A, 6B, and 6C depict, respectively, a front view, an oblique view, and a side view of an exemplary vibration device for applying vibrations to the user and capable of being used in the vibration system of FIG. 5.
Figure 6A:
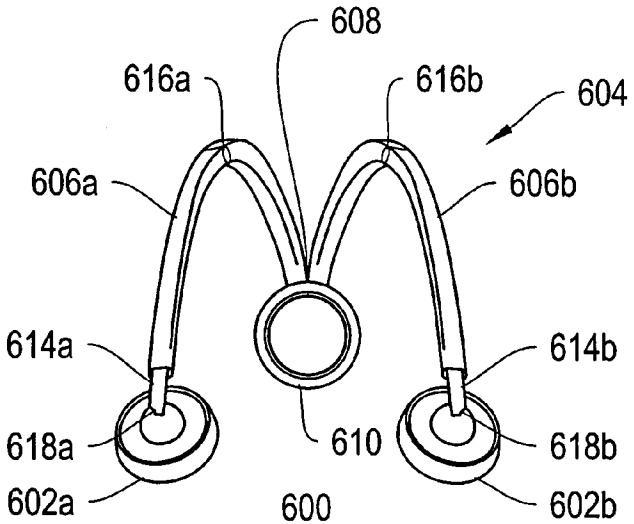

FIGS. 6A-8 depict in more detail an illustrative embodiment of the vibration device 502. In particular, FIGS. 6A-6C depict, respectively, a front view, an oblique view, and a side view of an exemplary vibration device 600 having two vibrators 602*a* and 602*b* positioned by a support structure 604. The vibrators 602*a* and 602*b*, described below in reference to FIG. 8, can include any suitable mechanism capable of transforming an electrical signal into vibration, such as a transducer or an off-balance rotor. The vibrators 602*a* and 602*b* attach to a support structure 604 that includes two curved harnesses 606*a* and 606*b* joined at a point of attachment 608. In particular, the vibrators 602*a* and 602*b* can attach to ends of the curved harnesses 606*a* and 606*b*, or alternatively to adjustable endpieces 614*a* and 614*b* nested within the ends of the curved harnesses 606*a* and 606*b*, via vibrator joints 618*a* and 618*b*. The curved harnesses 606*a* and 606*b* can have harness joints, respectively 616*a* and 616*b*. The point of attachment 608 can have an additional rear vibrator 610 or, alternatively, a rear cushion. The point of attachment 608 can also have an adductor joint 612.

Figure 7:
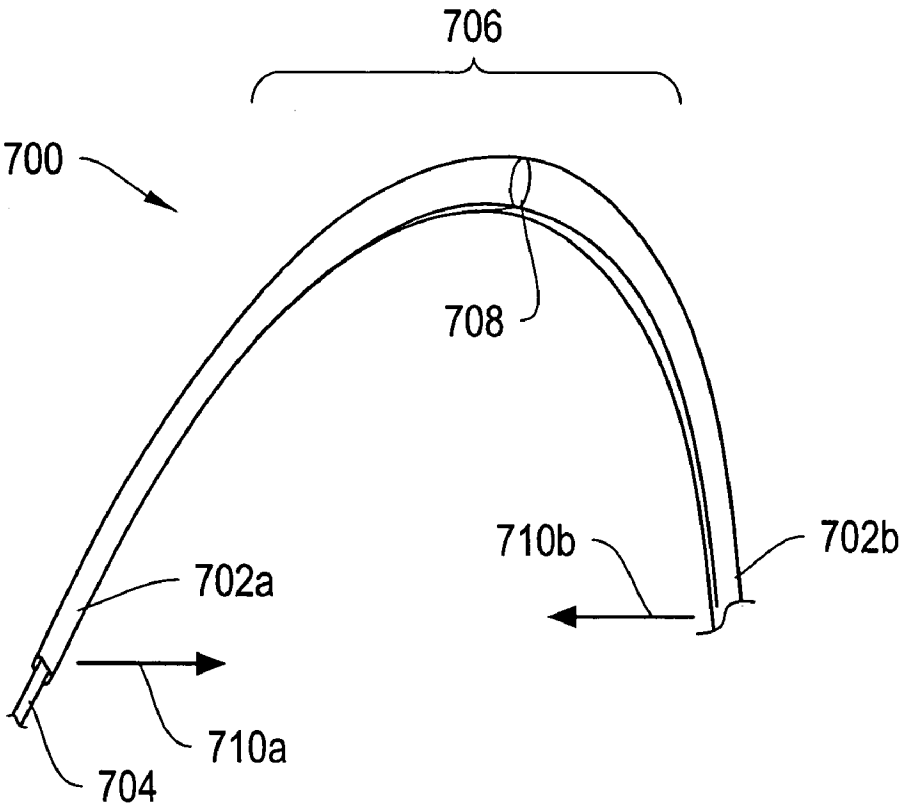
FIG. 7 depicts a side view of an exemplary harness and an exemplary adjustable endpiece both capable of being used in the vibration devices of FIGS. 5-6C.

FIG. 7 depicts an exemplary curved harness 700 and adjustable endpiece 704 that can be used in the support structure 604. The curved harness 700 has two ends 702*a* and 702*b* configured to flex inwardly toward each other, as indicated by arrows 710*a* and 710*b*. The end 702*a* has an adjustable endpiece 704 nested within the curved harness 700. The adjustable endpiece 704 is capable of sliding in and out of the curved harness 700 to adjust a length of the curved harness 700. Between the ends 702*a* and 702*b* is a harness midsection 706, which can include a harness joint 708. The curved harness 700 and the adjustable endpiece 704 can be made of any suitably light, tensile material such as plastic, include padding such as fabric padding along their surfaces that are adjacent to the user to provide a more comfortable fit, and have external surfaces sufficiently tacky to prevent slippage when the surface rests against skin or fabrics typically used in clothing. Examples of suitable materials for their external surfaces include synthetic rubber and fabric used to cover audio speakers. The curved harness 700 can be between 10 inches and 13 inches in length and ¼ inches and 1 inch in width, while the adjustable endpiece 704 can be between 2 inches and 4 inches in length and ⅛ inches and ¾ inches in width.

Figure 8:
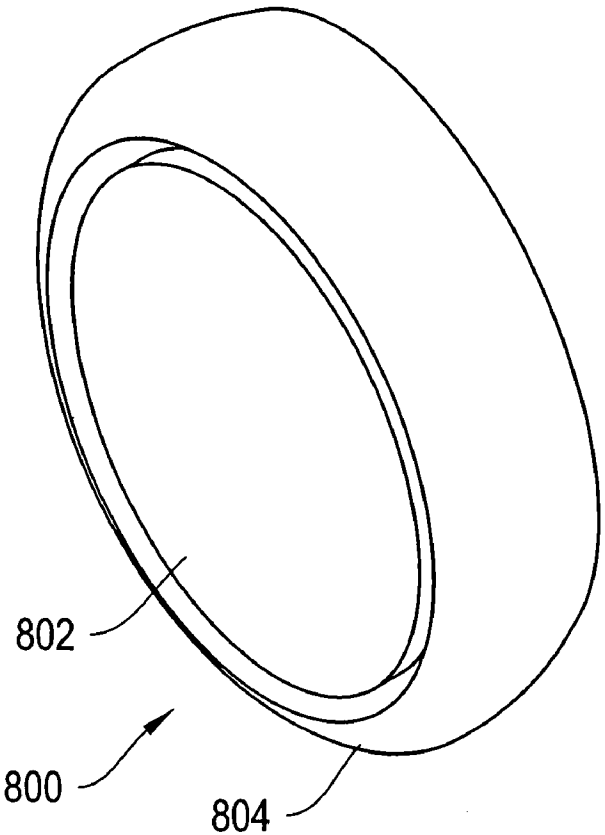
FIG. 8 depicts an oblique view of an exemplary vibrator capable of being used in the vibration devices of FIGS. 5-6C, 9-12B, and 16.

FIG. 8 depicts an exemplary vibrator 800 that can be used in the vibration device 600. The vibrator 800 has a diaphragm 802 capable of vibrating in response to an electrical signal. The diaphragm 802 can be between 0.5 inches and 4 inches in diameter, with a preferred size dependent on the user's size. In particular, the diaphragm diameter can be approximately 20% of a lateral length measured from a first shoulder of the user to a second shoulder of the user. A thin cushion (not shown) can overlay the diaphragm 802 and be disposed between the diaphragm 802 and the user to soften the impact of the vibrations on the user. The thin cushion may be made of any suitable material that is sufficiently resilient and can provide padding, such as a silicone gel. An external surface of the diaphragm 802 can be any suitable material that is sufficiently tacky to prevent slippage when the external surface rests against skin or fabrics typically used in clothing. Examples of suitable materials include synthetic rubber, polyurethane, fabric used to cover audio speakers, and foam cushion used to cover headphone speakers. The surface material is typically between 1 mm and 5 mm in thickness. A cushion 804 can encircle the vibrator 800 to protect the edge of the diaphragm 802.

Figure 9:
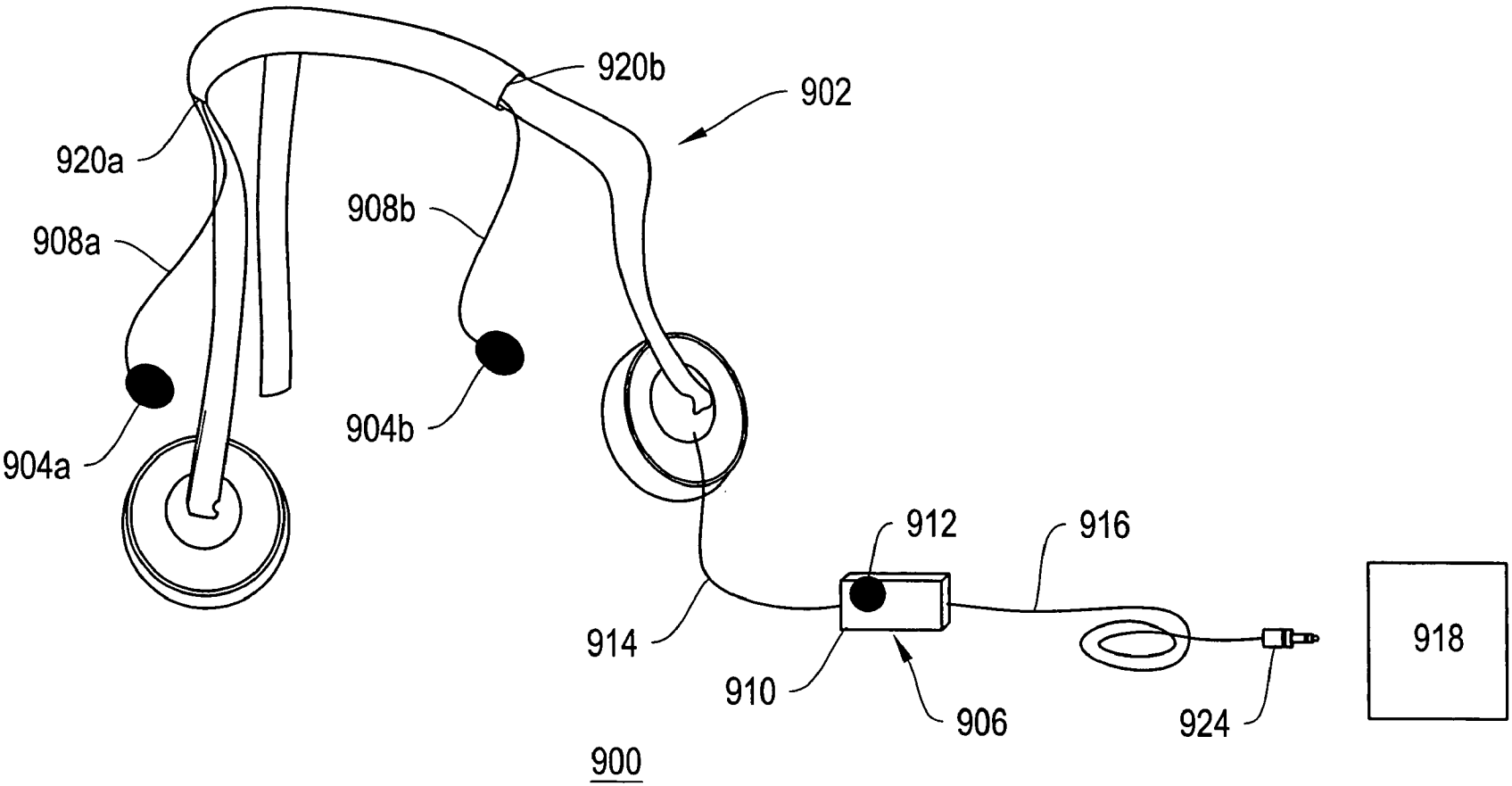
FIG. 9 depicts a front view of an exemplary vibration system for experiencing audio and haptic data.

FIG. 9 depicts an exemplary vibration system 900 for experiencing audio and haptic data according to one aspect of the invention. The vibration system 900 includes a vibration device 902, optional audio speakers 904*a* and 904*b*, and a processor 906. The vibration device 902 is described below in reference to FIGS. 10A-11. The optional audio speakers 904*a* and 904*b* can be any suitable audio device, such as an earphone, headphone, or neckphone, and can be attached by wires 908*a* and 908*b* to the vibration device 902 at joints 920*a* and 920*b*. Alternatively, the audio speakers can be separate from the vibration device 902 or the user can opt to not have or use audio speakers in conjunction with the vibration device 902.

The depicted processor 906 includes a housing 910 that encases the processing circuitry, and supports user control interfaces such as a button, switch, or dial 912. The housing attaches by wire 914 to the vibration device 902 and by wire 916 to any suitable source 918 of audio or haptic data, such as a portable music device or video game console. The wires 914 and 916 may each have an audio jack, such as the audio jack 924 attached to the end of the wire 916, for connecting to, respectively, the processor 906 and the data source 918. Alternatively, the vibration device 902 can attach directly to a data source 918. In another alternative, the vibration device 902, the processor 906, and the data source 918 can include, respectively, a wireless receiver, a wireless transceiver, and a wireless transmitter for communicating audio or haptic data.

Figure 10B:
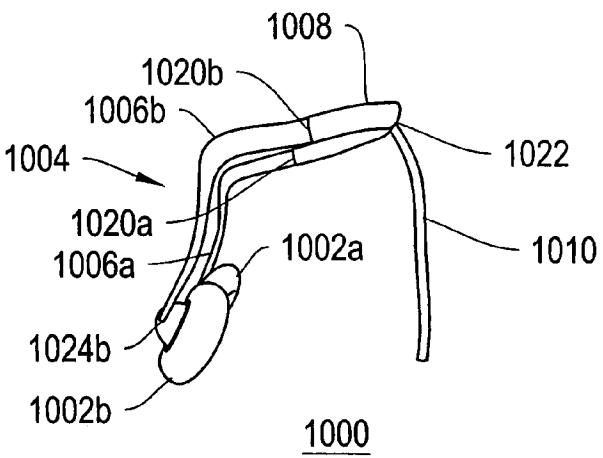
FIGS. 10A, 10B, and 10C depict, respectively, a front view, a side view, and a top view of an exemplary vibration device for applying vibrations to the user and capable of being used in the vibration system of FIG. 9.
Figure 10A:
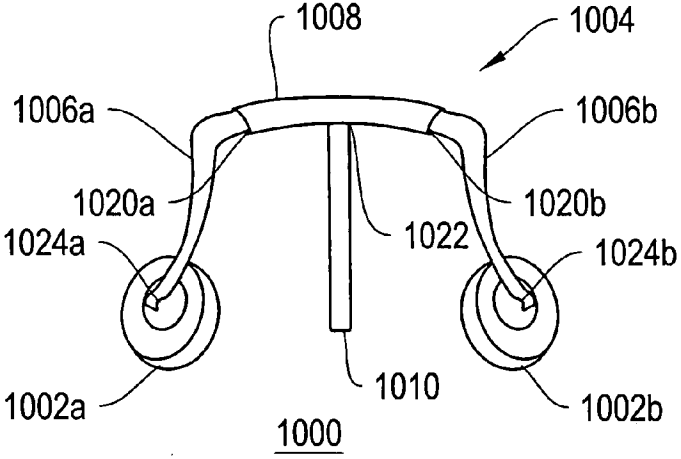
Figure 10C:
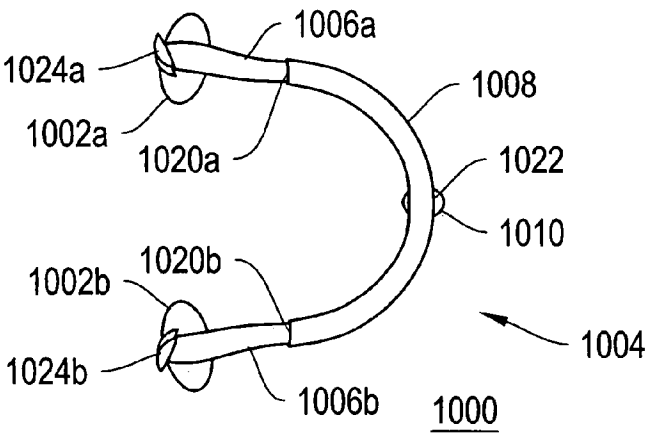
Figure 11:
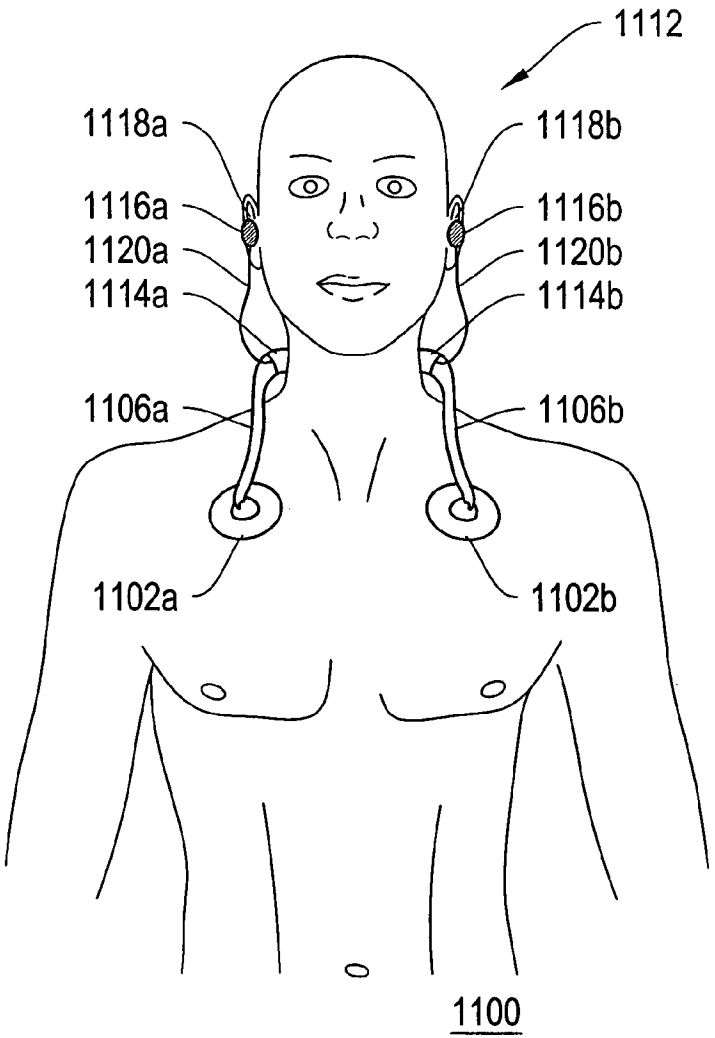
FIG. 11 depicts a front view of an exemplary vibration device and exemplary audio speakers being applied to the user and capable of being used in the vibration system of FIG. 9.

FIGS. 10A-11 depict in more detail an illustrative embodiment of the vibration device 902. In particular, FIGS. 10A-10C depict, respectively, a front view, a side view, and a top view of an exemplary vibration device 1000 having two vibrators 1002*a* and 1002*b* positioned by a support structure 1004. The vibrators 1002*a* and 1002*b*, described above in reference to FIG. 8, can include any suitable mechanism capable of transforming an electrical signal into vibration. The vibrators 1002*a* and 1002*b* attach via vibrator joints 1024*a* and 1024*b* to a support structure 1004 that includes bent elements 1006*a* and 1006*b* joined at bent element joints 1020*a* and 1020*b* to a semi-circular element 1008. The semi-circular element 1008 attaches via a midpoint joint 1022 to a long element 1010 depending vertically from a midpoint of the semi-circular element 1008. The support structure 1004 can be made of any suitably light, tensile material such as plastic and have a surface sufficiently tacky to prevent slippage when the surface rests against skin or fabrics typically used in clothing. Examples of suitable materials include synthetic rubber and fabric used to cover audio speakers.

FIG. 11 depicts a vibration device 1100 being worn by a user 1112. A semi-circular element, which is not shown, is adapted to encircle a back of a neck of the user 1112 with a long element, also not shown, centered on an upper back of the user 1112. The bent elements 1106*a* and 1106*b* are adapted to attach to vibrators 1102*a* and 1102*b* and feature bends 1114*a* and 1114*b* having an angle configured to fit on a front shoulder of the user 1112. Accompanying audio speakers can be earbuds 1116*a* and 1116*b* attached by wires 1120*a* and 1120*b* to the vibration device 1100 and adapted to fit within ears 1118*a* and 1118*b* of the user 1112.

Figure 12:
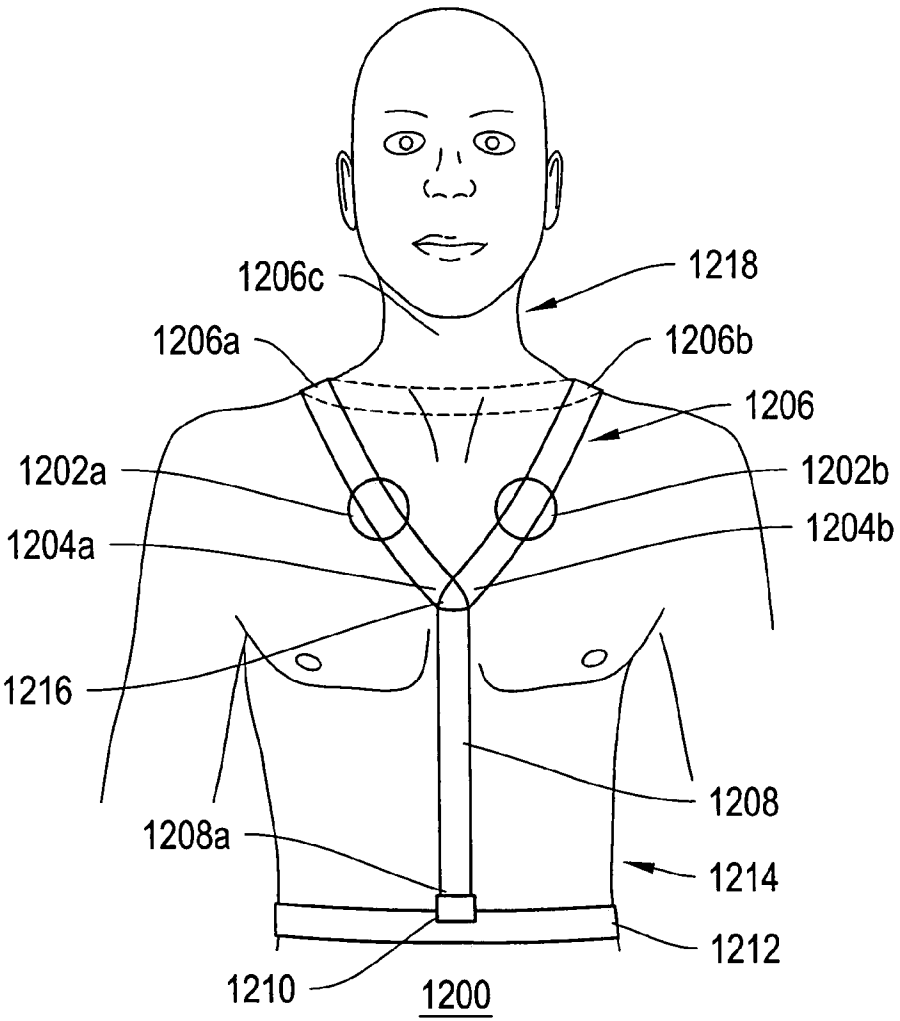
FIG. 12 depicts, a front view and of an exemplary vibration device for applying vibrations to the user.

FIG. 12 depicts a front view of another exemplary vibration device 1200 being worn by a user 1214. The vibration device 1200 has two vibrators 1202*a* and 1202*b* supported by a loop of stretchable band 1206 that loops around the neck 1218 of the user. The stretchable band 1206 has two substantially symmetric front portions 1206*a* and 1206*b*, whose ends 1204*a* and 1204*b* meet at a point 1216 to form a V shaped structure adjacent to the chest of the user 1214, and a back portion 1206*c* that curves around the back of the neck 1218 of the user. The vibrators 1202*a* and 1202*b*, described above in reference to FIG. 8, attach to front portions 1206*a* and 1206*b*, respectively, and can include any suitable mechanism capable of transforming an electrical signal into vibration. The ends 1204*a* and 1204*b* connect to a vertical stretchable band 1208 that depends from the point 1216 to approximately the waist of the user. The stretchable bands 1206 and 1208 may be made of any suitable material that is sufficiently flexible and stretchable, such as elastic fabric. Vertical stretchable band 1208 may have a fastener 1210, attached to a free end 1208*a*. The fastener 1210 can be any suitable device capable of attaching to a waistband 1212 of clothing to hold the vibration device 1200 in place.

Figure 14:
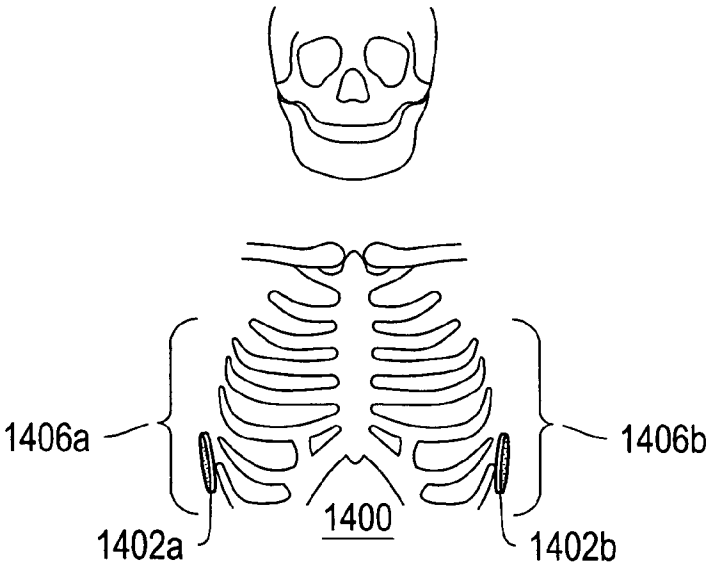
FIG. 14 depicts a front view of vibrator locations with respect to the body's underlying skeletal system.
Figure 13:
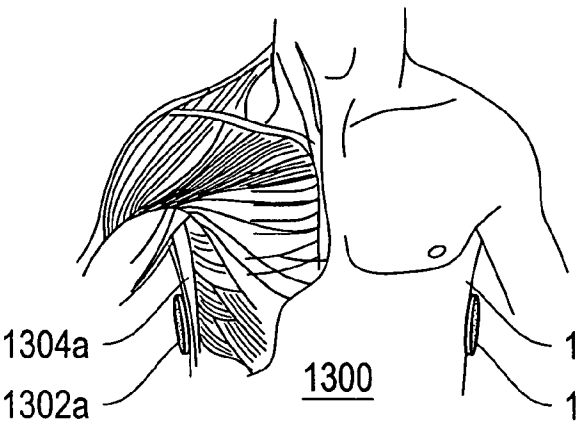
FIG. 13 depicts a front view of vibrator locations with respect to the body's underlying musculature.
Figure 15:
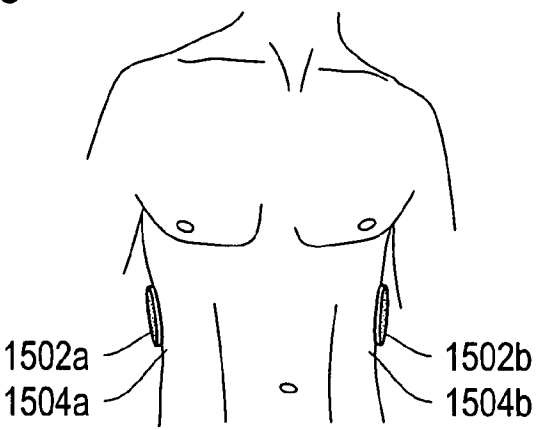
FIG. 15 depicts a front view of vibrator locations with respect to the body's external surface.

FIGS. 13-15 depict other vibrator location arrangements 1300, 1400, and 1500 on a human body. In particular, FIG. 13 depicts vibrator locations 1302*a* and 1302*b* with respect to the body's underlying musculature; FIG. 14 depicts vibrator locations 1402*a* and 1402*b* with respect to the body's underlying skeletal system; and FIG. 15 depicts vibrator locations 1502*a* and 1502*b* with respect to the body's external surface.

As depicted by FIG. 13, vibrator location arrangement 1300 has vibrator locations 1302*a* and 1302*b* disposed symmetrically across a torso of the body. A first vibrator location 1302*a* is located adjacent to a first abdominal external oblique muscle 1304*a*; and similarly a second vibrator location 1302*b* is located adjacent to a second abdominal external oblique muscle 1304*b*. Both vibrator locations 1302*a* and 1302*b* can be located on the front-back coronal plane 410, depicted in FIG. 4.

As depicted by FIG. 14, vibrator location arrangement 1400 has vibrator locations 1402*a* and 1402*b* disposed symmetrically across a torso of the body. A first vibrator location 1402*a* is located adjacent to a region 1406*a* of a rib cage which includes the third through tenth rib, known as costae verae III-X; and similarly a second vibrator location 1402*b* is located adjacent to a region 1406*b* of a rib cage which includes the third through tenth rib. Both vibrator locations 1402*a* and 1402*b* can be located on the front-back coronal plane 410, depicted in FIG. 4.

As depicted by FIG. 15, vibrator location arrangement 1500 has vibrator locations 1502*a* and 1502*b* disposed symmetrically across a torso of the body. A first vibrator location 1502*a* is located adjacent to a first abdominal external oblique muscle 1504*a*; and similarly a second vibrator location 1502*b* is located adjacent to a second abdominal external oblique muscle 1504*b*. Both vibrator locations 1502*a* and 1502*b* can be located on the front-back coronal plane 410, depicted in FIG. 4.

Figure 16:
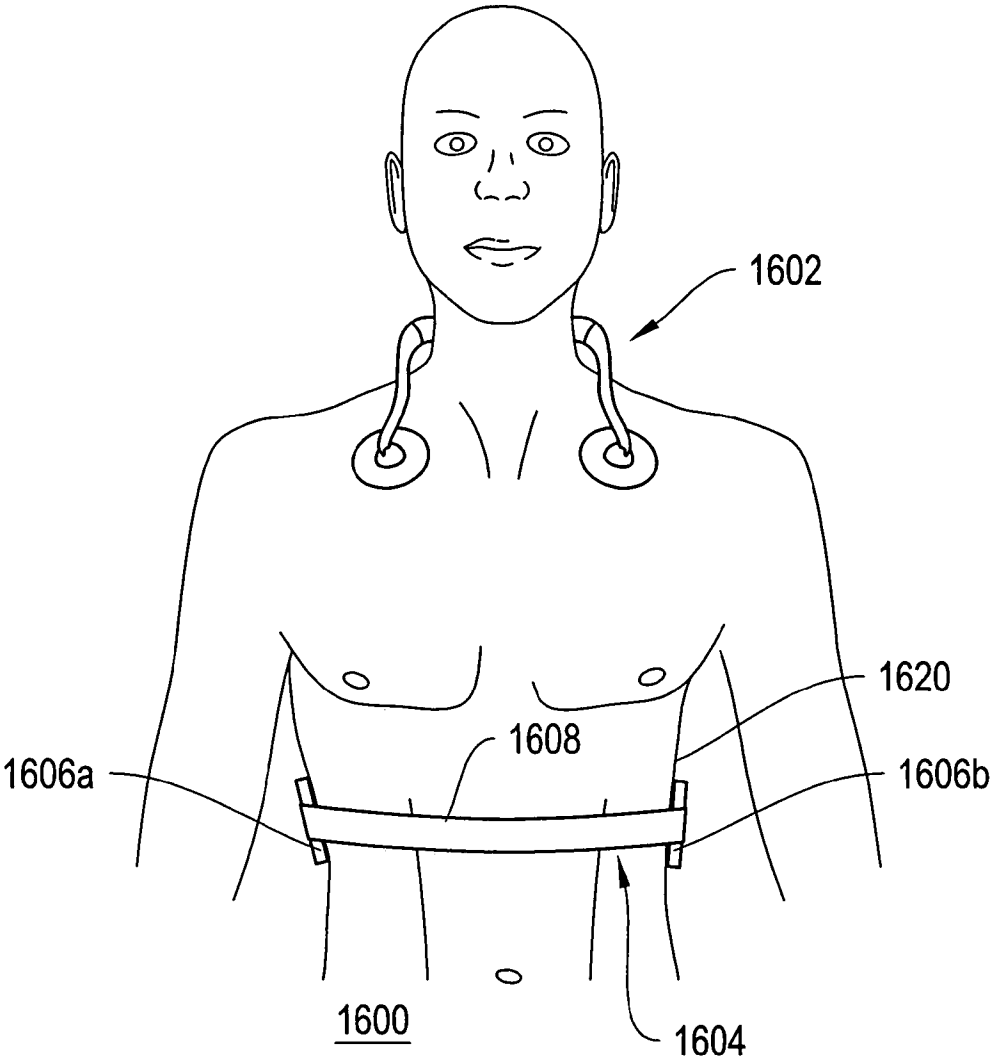
FIG. 16 depicts a front view of an exemplary vibration device for applying vibrations to the user.

Vibrator location arrangements 1300, 1400, and 1500 may be implemented by the exemplary vibration device 1600 depicted in FIG. 16. Vibration device 1600 includes a chest vibration device 1602, which is similar to vibration devices 902, 1000, and 1100 described above and depicted in FIGS. 9-11, and a torso vibration device 1604. Alternatively, the user can opt to use the torso vibration device 1604 without the chest vibration device 1602. The torso vibration device 1604 includes a right vibrator 1606*a* and a left vibrator 1606*b* both attached to a stretchable band 1608 which encircles a torso 1620 of the human body. The vibrators 1606*a* and 1606*b* can include any suitable mechanism capable of transforming an electrical signal into vibration. The stretchable band 1608 can be made of any suitable material that is sufficiently flexible and stretchable, such as elastic fabric. The surface of the stretchable band 1608 is preferably adapted to reduce slippage when disposed on clothing or skin to prevent the torso vibration device 1604 from moving with respect to the torso 1620.

Figure 17:
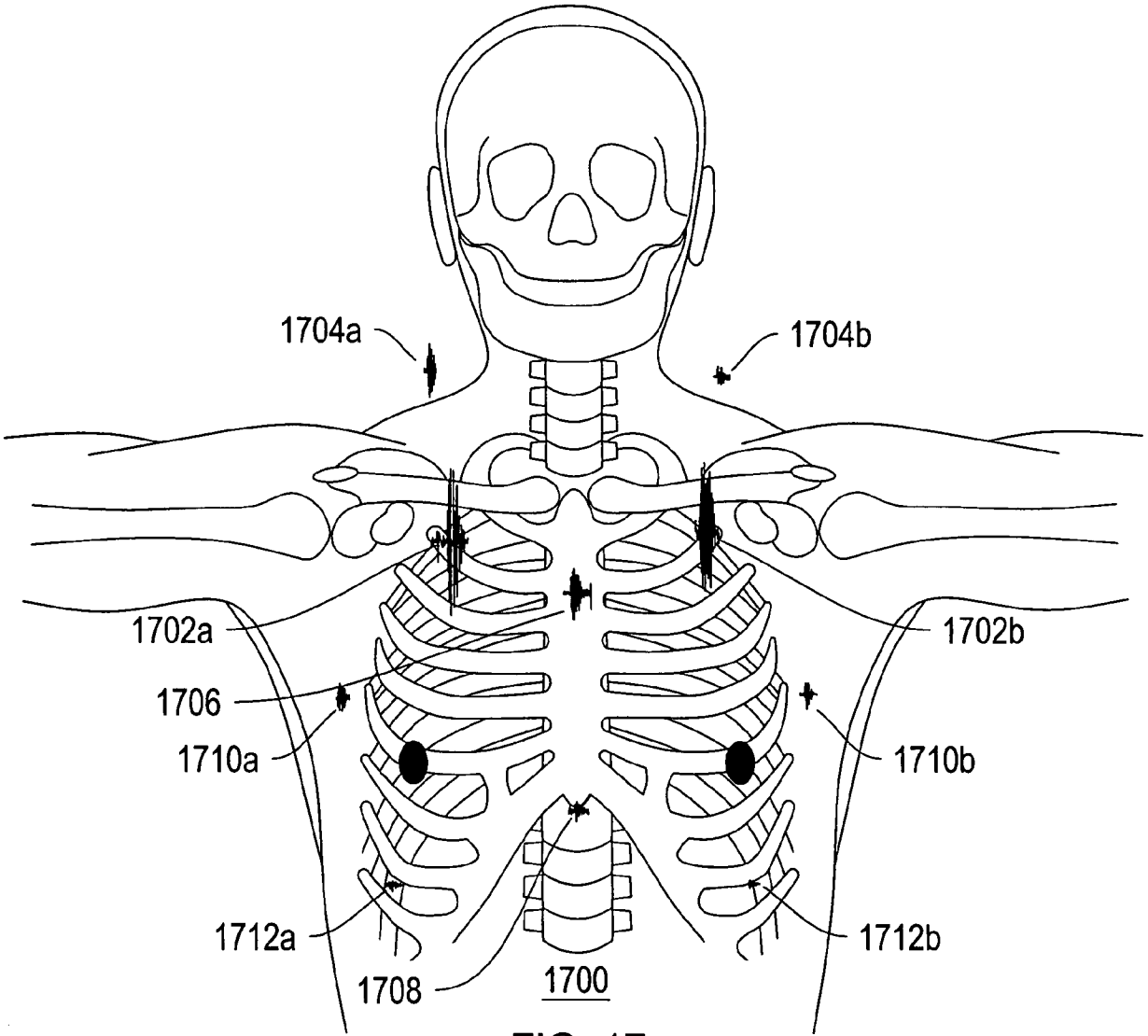
FIG. 17 depicts a natural surface vibration pattern that can be used to determine vibrator locations.

Other vibrator arrangements may also enhance a user's interaction with audio or visual content being presented. According to another aspect of the invention, one characteristic of a vibrator arrangement uses a pattern of vibrations measured on a human body's surface, called a surface vibration pattern. A natural surface vibration pattern occurs when the user generates sound, such as when the user is laughing or shouting. FIG. 17 depicts an exemplary natural surface vibration pattern 1700 of a user. In particular, FIG. 17 depicts pictorially the mechanical vibrations recorded at a variety of surface locations on the body's torso. A stethoscope was placed in contact with each surface location and coupled at its opposing end to a microphone, whose electronic signal output was recorded when the user was generating sound. Each waveform depicted in FIG. 17 represents the output recorded at that location and is sized according to the same scale to demonstrate the relative amplitudes of the surface locations. Other tests may also be suitable for measuring the surface vibrations on the body. In this example, the amplitudes are largest at symmetric pectoralis major muscle locations 1702*a* and 1702*b*, smaller at symmetric upper trapezius muscle locations 1704*a* and 1704*b* and a sternum location 1706, and smallest at a xyphoid process location 1708, underarm locations 1710*a* and 1710*b*, and sides of the ribcage locations 1712*a* and 1712*b*.

Figure 18:
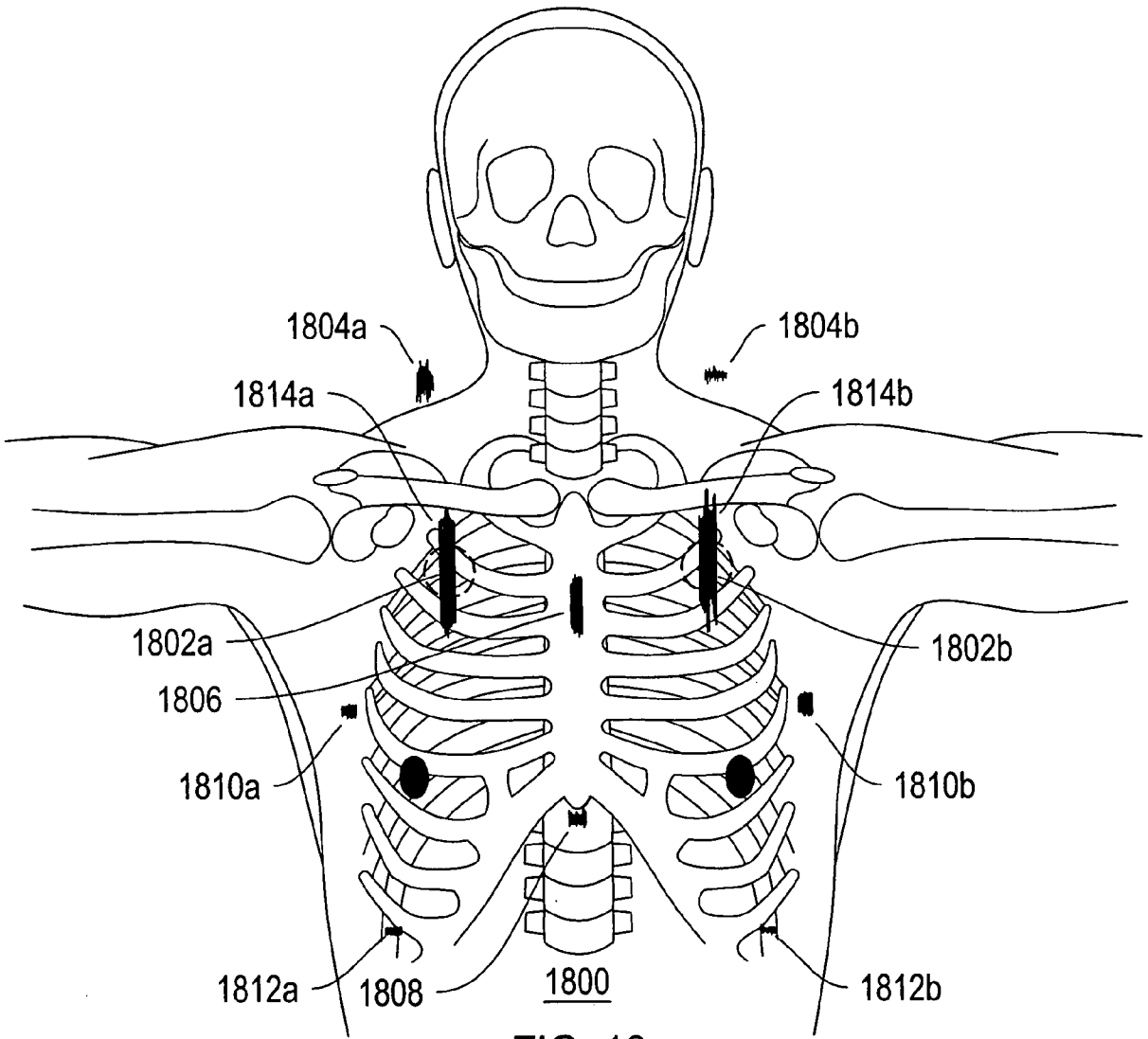
FIG. 18 depicts a vibrator-induced surface vibration pattern that can be used to evaluate vibrator locations.

A vibrator location arrangement can induce a surface vibration pattern similar to the natural surface vibration pattern. This similarity in surface vibration patterns is preferably with respect to relative amplitudes across a variety of surface locations on the body. An exemplary vibrator-induced surface vibration pattern 1800, depicted in FIG. 18, has relative amplitudes across a set of surface locations that are similar to those of the natural surface vibration pattern 1700 depicted in FIG. 17. The amplitudes depicted in FIG. 18 were found in a similar manner to those of FIG. 17, except the microphone output was recorded when the user was using an exemplary vibration device instead of when the user was generating sound. In particular, the average amplitudes depicted in FIG. 18, like those of FIG. 17, are largest at symmetric pectoralis major muscle locations 1802*a* and 1802*b*, smaller at symmetric upper trapezius muscle locations 1804*a* and 1804*b* and a sternum location 1806, and smallest at a xyphoid process location 1808, underarm locations 1810*a* and 1810*b*, and sides of the ribcage locations 1812*a* and 1812*b*. The vibrators used to generate the vibrations of FIG. 18 were arranged in locations 1814*a* and 1814*b*, similar to vibrator location arrangements 100, 200, 300, and 400. Additional testing may be performed to determine other possible vibrator location arrangements that may create an immersive experience for the user.

Vibrator location arrangements can be symmetric with respect to the body's front-back coronal plane 410 and left-right median plane 412, depicted in FIG. 4. An arrangement of locations that is symmetric with respect to a plane may include locations that are on the plane, such as vibrator location 402, depicted in FIG. 4, which lies on the front-back coronal plane 410. Vibrator location arrangements symmetric with respect to the left-right median plane 412 include vibrator location arrangements 100, 200, 300, 1300, 1400, and 1500, depicted in FIGS. 1-3 and 13-15.

Vibrator location arrangements can space vibrators away from a sternum of the body, as depicted in vibrator location arrangements 100, 200, 300, 1300, 1400, and 1500 of FIGS. 1-3 and 13-15. Prolonged vibration of the sternum can irritate and inflame cartilage that connects the sternum to the ribs, creating a painful condition known as costochondritis.

A vibration system as described above may receive electrical signals containing audio, haptic, and other data from a variety of media and devices. Example media include music, movies, television programs, video games, and virtual reality environments. Example devices that can provide data and be used in conjunction with a vibration device include portable music players, portable video players, portable video game consoles, televisions, computers, and home entertainment systems. Exemplary vibration systems may connect to exemplary devices via an audio jack coupled to a wire, as depicted in FIGS. 5 and 9, or may contain a wireless receiver for wirelessly receiving signals from a device equipped with a wireless transmitter.

Using a vibration device in conjunction with a media device can enhance the user's interaction with the media by creating tactile sensations that synchronize with the data being presented by the media device. For example, soundtracks that accompany movies typically have, in addition to music and dialogue, sounds that accompany the action in the movie, such as a door slamming or an explosion. The vibration device, by transforming these sounds into vibrations, allows the user to simultaneously feel this action in addition to seeing and hearing it, which can create a more immersive experience for the user. This immersive effect can be especially desirable when the visual data is poor, for example portable devices with small video screens or computer monitors with relatively low resolution. As another example, the user's perception of music may be enhanced by the vibration device, which can create a tactile sensation synchronized with the music by using the same data source as the audio speakers. This enhancement can be especially desirable for experiencing the low frequency component, also known as bass.

The vibration device can include processing circuitry capable of processing electrical signals for enhancing the content perceived by the user or allowing the user to modify the content. Processing circuitry may be housed externally to the vibration device, as depicted in the embodiments of FIGS. 5 and 9, or internally within the vibration device.

Exemplary functions of processing circuitry include pitch control, volume control, fade-in, amplitude-ceiling, auto shut-off, channel separation, phase-delay, and bass enhancement, whose implementations are well-known to one skilled in the art. Pitch control allows a user to increase or decrease the overall frequency of an electrical signal. Volume control allows a user to increase or decrease the overall amplitude of an electrical signal. Fade-in gradually increases the amplitude of the beginning of an electrical signal to lessen the initial impact of vibrations on a user. Amplitude-ceiling creates an upper bound on the magnitude of the amplitude of the electrical signal to prevent the user from experiencing excessively intense vibrations. Auto shut-off turns off the processing circuitry to conserve power without receiving input from the user and when an electrical signal has not been received for a preset amount of time. Channel separation separates a stereo or multichannel signal into its component channels. Phase-delay delays a signal sent to a second vibrator with respect to a signal sent to a first vibrator to give the user the impression the sound originated from a location closer to the first vibrator than the second vibrator. Bass enhancement increases the amplitude of the bass component of an electrical audio signal relative to the rest of the signal.

Examples of multichannel signals that can be separated by processing circuitry include stereo sound, surround sound, and multichannel haptic data. Stereo sound typically uses two channels. Channel separation circuitry can separate a stereo sound two-channel electrical audio signal into a left channel signal and a right channel signal intended to be experienced by the user from, respectively, a left-hand side and a right-hand side. Multichannel electrical audio signals, such as those used in 5.1 and 6.1 surround sound, can similarly be separated, and typically contain rear channel signals intended to be experienced by the user from the rear. Channel separation circuitry can also separate multichannel haptic data, such as those used with video games or virtual reality environments, that similarly contain data intended to be experienced by the user from a specific direction.

Multiple implementations of bass enhancement are possible. An exemplary processing circuitry 1900 for bass enhancement is depicted in FIG. 19. An electrical signal is received at an input 1902 for transmitting to a vibration device 1904 and audio speakers 1906. A low frequency cross-over circuit 1908 can filter through only the bass component of the received electrical signal, whose overall amplitude is increased by an amplifier 1910 before reaching a vibration device 1904.

Another bass enhancement implementation increases the bass component without filtering out the rest of a signal. Processing circuitry can sample a received electrical signal to create a sampled signal, modulate the pitch of the sampled signal to create a modulated sampled signal, and mix the modulated sampled signal with the received electrical signal to create a signal for the vibration device. The modulation of the pitch preferably lowers the pitch of the sampled signal to increase the bass component of the signal received by the vibration device. The user may also control the degree of bass enhancement by lowering the overall frequency of a signal using pitch control.

Processing circuitry can send different signals, each based on an electrical signal received from a source of data, to different destinations. The different destinations can include audio speakers and vibrators that are differentiated by their position relative to the body. For example, the electrical signals generated by channel separation can be transmitted to speakers or vibrators having appropriate positions relative to the body. In particular, signals intended to be experienced from the left can be sent to speakers or vibrators left of the left-right median plane, signals intended to be experienced from the right can be sent to speakers or vibrators right of the left-right median plane, signals intended to be experienced from the rear can be sent to speakers or vibrators rear of the front-back coronal plane, and signals intended to be experienced from the front can be sent to speakers or vibrators anterior of the front-back coronal plane. Exemplary vibration device 600, depicted in FIG. 6, can include a rear vibrator 610 for receiving a rear channel generated by channel separation processing circuitry. Exemplary torso vibration device 1604, depicted in FIG. 16, can include a left vibrator 1606*b* and a right vibrator 1606*a* for receiving, respectively, a left channel and a right channel generated by channel separation processing circuitry.

Processing circuitry can also combine multiple functions and can apply different sets of functions to electrical signals depending on their destinations. Preferably, signals sent to vibrators have undergone bass enhancement. For example, the embodiment 1900 depicted in FIG. 19 applies a bass enhancement implementation 1908 and 1910 to an electrical signal destined for a vibration device 1904, and applies a direct coupling between the input 1902 and an electrical signal destined for audio speakers 1906. Different speakers and vibrators may also each have individual controllers to allow the user more flexibility in controlling the immersive experience.

Once the electrical signals have been processed, the modified electrical signals can be transmitted to a vibration device, exemplified by vibration devices 502, 902, 1200, and 1600 depicted in, respectively, FIGS. 5, 9, 12, and 16. The vibration devices have vibrators capable of transforming received electrical signals into mechanical movement. The mechanical movement can take the form of a vibration whose amplitude and frequency match those of the received electrical signal. In a preferred embodiment, the vibrator has a flat or concave surface, called a diaphragm, that vibrates to create the matching mechanical movement. Examples of mechanisms capable of generating vibration in response to an electrical signal include an inertial transducer, a piezoelectric transducer, a tactile transducer, and a motor with an off-balance rotor.

The support structure of the vibration device can serve multiple purposes for insuring the vibration device imparts an immersive experience to the user. The support structure can dispose vibrators in vibrator location arrangements and insure the vibrators can transfer vibration to the user. Other support structure qualities include a comfortable fit, ease of use, and an inconspicuous presence when worn.

The support structure of the vibration device can be configured to position vibrators according to vibrator location arrangements, such as those described above and in reference to FIGS. 1-4 and 13-15. For example, the support structure of the vibration device 502 depicted in FIG. 5 positions vibrators in vibrator locations 522*a* and 522*b*. Similarly, the support structure 604 depicted in FIGS. 6A-6C can position the vibrators 602*a* and 602*b* according to vibrator location arrangements 100, 200, 300, and 400 depicted in FIGS. 1-4. The user can also adjust the positioning of the vibrators by using the adductor joint 612 to adjust the harnesses 606*a* and 606*b* laterally and the adjustable endpieces 612*a* and 612*b* to adjust the length of the harnesses 606*a* and 606*b*. The support structure 1004 depicted in FIG. 10 and the suspenders 1204 depicted in FIG. 12 can position vibrators, respectively, 1002*a* and 1002*b*, and 1202*a* and 1202*b*, also according to vibrator location arrangements 100, 200, 300, and 400 depicted in FIGS. 1-4. The stretchable band 1608 of the torso vibration device 1604 depicted in FIG. 16 can position vibrators 1606*a* and 1606*b* according to vibrator location arrangements 1300, 1400, and 1500.

The support structure can also be configured to align a diaphragm 802 of a vibrator 800, depicted in FIG. 8, substantially parallel to a surface of the user at the vibrator location to insure that as much as possible of the diaphragm 802 is in contact with the user. For example, the support structure 604 depicted in FIGS. 6A-6C has vibrator joints 618*a* and 618*b* capable of adjusting the angle at which the vibrators 602*a* and 602*b* are oriented. The user can adjust the vibrators 602*a* and 602*b* to an angle that orients the diaphragms of the vibrators 602*a* and 602*b* substantially parallel to the surface of the chest of the user 520 at vibrator locations 522*a* and 522*b* depicted in FIG. 5. Similarly, the support structure 100 depicted in FIGS. 10A-10C has vibrator joints 1020*a* and 1020*b* capable of adjusting the angle at which the vibrators 1002*a* and 1002*b* are oriented.

The support structure can also be configured to push the vibrators against the body to insure the user can sense the vibrations of the vibrators. Support structures that include tensile elements can have rigidity sufficient to push the vibrators against the body. For example, the support structure 604 depicted in FIGS. 6A-6C has curved harnesses 606*a* and 606*b* configured to flex inwardly, which pushes the vibrators 602*a* and 602*b* against the body. In another example, the support structure 1004 depicted in FIG. 10 includes a long element 1010 attached to a semi-circular element 1008. The angle between the long element 1010 and a plane of the semi-circular element 1008 is preferably sufficiently acute to push the vibrators 1002*a* and 1002*b* against the body. Other embodiments contain non-tensile support structures configured to push the vibrators. For example, support structures that include stretchable bands, such as the suspenders 1204 depicted in FIG. 12 and the stretchable band 1608 depicted in FIG. 16, can be made of an elastic material. The elasticity of the stretchable bands pushes the vibrators 1202*a*, 1202*b*, 1606*a*, and 1606*b* against the body.

The support structures described herein can be configured to fit snugly without being too compressive on the body, are straightforward to put on over the shoulders or around the torso, and can be worn underneath clothing without significantly altering the profile of the clothing.

Embodiments of the vibration device may also be foldable to facilitate storage and portability of the device. Vibration device support structures that can be made of fabric, such as the suspenders 1204 depicted in FIG. 12 and the stretchable band 1608 of the torso vibration device 1604 depicted in FIG. 16, can easily fold into a myriad of shapes. Vibration devices made of a more rigid material can have joints or hinges for facilitating folding.

Figure 6C:
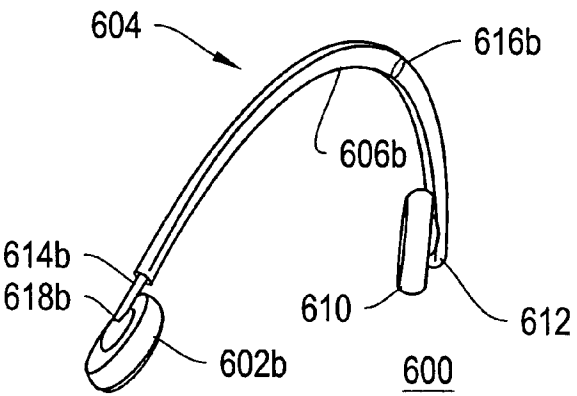

For example, exemplary vibration device 600 depicted in FIGS. 6A-6C can have joints 612, 616*a*, and 616*b* adapted for folding up the vibration device 600. In particular, the adductor joint 612 can adduct the two harnesses 616*a* and 616*b* together; and the harness joints 616*a* and 616*b* can allow the vibrators 602*a* and 602*b*, respectively, to fold towards the point of attachment 608. The joints 612, 616*a*, and 616*b* preferably have one degree of freedom and can be spring-loaded.

Similarly, exemplary vibration device 1000 depicted in FIGS. 10A-10C can have joints 1020*a*, 1020*b*, and 1022 adapted for folding the vibration device 1000 into substantially the same plane as the semi-circular element 1008. In particular, the bent element joints 1020*a* and 1020*b* can allow the bent elements 1006*a* and 1006*b* to fold upward and inward; and the midpoint joint 1022 can allow the long element 1010 to fold upward and inward. The joints 1020*a*, 1020*b*, and 1022 preferably have one degree of freedom and can be spring-loaded.

The foregoing embodiments are merely examples of various configurations of components of vibration systems described and disclosed herein and are not to be understood as limiting in any way. Additional configurations can be readily deduced from the foregoing, including combinations thereof, and such configurations and continuations are included within the scope of the invention. Variations, modifications, and other implementations of what is described may be employed without departing from the spirit and the scope of the invention. More specifically, any of the method, system and device features described above or incorporated by reference may be combined with any other suitable method, system, or device features disclosed herein or incorporated by reference, and is within the scope of the contemplated inventions.

I claim:

1. A vibration system comprising:

a vibrator capable of converting an electrical signal into a vibration, and a support structure for arranging the vibrator at a location on or about a human body such that a first pattern of vibrations are generated on the body's surface, wherein said first pattern matches in relative amplitude a second pattern of vibrations generated on the body's surface when the body generates sound.

2. The system of claim 1, further comprising a second vibrator arranged on or about the body on a pectoralis major muscle and spaced away from the sternum.

3. The system of claim 1, wherein the support structure includes a curved harness adapted to fit over a shoulder of the body and having two ends configured to flex inwardly toward each other.

4. The system of claim 3, wherein the support structure includes a second curved harness adapted to fit over a shoulder of the body and having two ends configured to flex inwardly toward each other.

5. The system of claim 4, wherein the two ends of each curved harness are adapted to flex inwardly and push a vibrator against the body.

6. The system of claim 5, further comprising an adjustable endpiece nested within a free end of each curved harness and capable of sliding in and out of the free end.

7. The system of claim 5, further comprising an adductor joint at a point of attachment of the two curved harnesses, adapted to adduct the two curved harnesses.

8. The system of claim 5, further comprising a harness joint at a midsection of each curved harness adapted to allow a free end of each curved harness to fold towards a point of attachment of the two curved harnesses.

9. The system of claim 5, further comprising a vibrator joint at a point of attachment of a vibrator to a free end of a curved harness, adapted to adjust an angle between the vibrator and the free end.

10. The system of claim 5, further comprising a vibrator positioned at a point of attachment of the two curved harnesses, adapted to convert a rear channel electrical audio signal of a surround sound system into a vibration.

11. The system of claim 1, wherein the support structure includes a bent element adapted to fit on a front of a shoulder of the body and having an end adapted to attach to the vibrator.

12. The system of claim 11, further comprising a vibrator joint at a point of attachment of the vibrator to the bent element, adapted to adjust an angle between the vibrator and the bent element.

13. The system of claim 11, wherein the support structure includes a semi-circular element adapted to fit around a back of a neck of the body and having two ends each adapted to attach to a bent element.

14. The system of claim 13, further comprising a bent element joint at a point of attachment of a bent element to the semi-circular element, adapted to fold the bent element and the semi-circular element together in a common plane.

15. The system of claim 13, wherein the support structure includes a long element vertically centered on an upper back of the body, attached to a midpoint of the semi-circular element at an angle adapted to push a vibrator against the body.

16. The system of claim 15, further comprising a midpoint joint at a point of attachment of the long element to the semi-circular element, adapted to fold the two elements together in a common plane.

17. The system of claim 1, wherein the support structure includes a first stretchable band adapted to fit around a neck, a second stretchable band connected to the first stretchable band and adapted to depend from the first stretchable band, and a fastener adapted to fasten the second stretchable band to a waistband.

18. The system of claim 1, further comprising a video display for generating a visual image.

19. The system of claim 1, further comprising a pitch controller capable of modulating a pitch characteristic of an electrical signal.

20. The system of claim 1, further comprising a volume controller capable of raising and lowering an amplitude characteristic of an electrical signal.

21. The system of claim 1, further comprising a fade-in device capable of gradually raising an amplitude characteristic of an electrical signal.

22. The system of claim 1, further comprising an amplitude-ceiling device capable of imposing an upper limit on an amplitude characteristic of an electrical signal.

23. The system of claim 1, further comprising:

a signal processing device capable of detecting that no electrical signal has been received for a preset amount of time, a power supply for powering a signal processing device, and an automatic shut-off device capable of turning off the signal processing device in response to the signal processing device detecting that no electrical signal is being received for the preset amount of time.

24. The system of claim 1, further comprising a bass-enhancement device capable of sampling a first electrical signal to create a sampled signal, modulating a pitch characteristic of the sampled signal to create a modulated sampled signal, and mixing the modulated sampled signal with the first electrical signal.

25. The system of claim 1, further comprising:

a low frequency cross-over circuit capable of filtering through low frequency sound from an electrical signal, and an amplifier capable of amplifying the electrical signal.

26. The system of claim 1, wherein the vibrator includes at least one of an inertial transducer, an off-balance rotor, a tactile transducer, or a piezoelectric transducer.

27. The system of claim 1, wherein a surface of the vibrator is made of at least one of synthetic rubber, silicone, foam cushion, or speaker cover fabric.

28. The system of claim 1, wherein a surface of the support structure is made of at least one of synthetic rubber or speaker cover fabric.

29. The system of claim 1, further comprising an audio speaker for generating sound.

30. The system of claim 1, wherein the support structure disposes a plurality of vibrators on a front-back coronal plane of the body and symmetrically across a left-right median plane of the body.

31. The system of claim 1, wherein the vibrator is arranged on or about a side of a torso of the body.

32. The system of claim 1, wherein the support structure includes a stretchable band adapted to encircle a torso of the body.

* * * * *